US005174053A

United States Patent [19]

Takeshita

[11] Patent Number: 5,174,053

[45] Date of Patent: Dec. 29, 1992

[54] SNOW PLOW

[75] Inventor: Masatoshi Takeshita, Iwata, Japan

[73] Assignee: Yamaha Hatsudoki Kabushiki Kaisha, Shizuoka, Japan

[21] Appl. No.: 369,750

[22] Filed: Jun. 22, 1989

[30] Foreign Application Priority Data

Jun. 23, 1988 [JP] Japan ..... 63-153514

[51] Int. Cl.[5] ..... E01H 5/09

[52] U.S. Cl. ..... 37/258; 37/248

[58] Field of Search ..... 37/248, 249, 250, 251, 37/252, 253, 255, 256, 257, 260, 258

[56] References Cited

U.S. PATENT DOCUMENTS 2,632,263 3/1953 Cooper ..... 37/252 X
3,673,715 7/1972 Lines ..... 37/251

FOREIGN PATENT DOCUMENTS 599833 6/1960 Canada ..... 37/250

OTHER PUBLICATIONS

"Snapper" brochure, McDonough Power Equipment, McDonough Ga.

*Primary Examiner*—Dennis L. Taylor
*Assistant Examiner*—Arlen L. Olsen

[57] ABSTRACT

A snow thrower incorporating a device fixed relative to the auger housing around the auger shaft for generating a downward thrust on the auger shaft which opposes and balances the upward thrust caused on the auger shaft by the cooperation of the auger with the snow. The downward thrust is provided by shaping a portion of the housing for the drive of the auger shaft in such a way so as to create a static downward thrust.

14 Claims, 5 Drawing Sheets

SNOW PLOW

BACKGROUND OF THE INVENTION

This invention relates to a snow plow and more particularly to an improved snow blower type of snow plow and construction therefor.

One commonly used form of snow plow is the snow blower type of arrangement. Such a snow blower normally consists of an auger housing having a forwardly facing opening that is adapted to be moved into a body of snow. An auger is supported for rotation on an auger shaft that extends transversely across the auger housing and includes opposite hand portions that collect the snow and deliver it to a central location for transmission to an impeller area. An impeller in the impeller area throws the snow to the side of the path being cleared. This type of arrangement is highly useful and effective in removing snow. However, the operation of the auger tends to give rise to a vertically upward force on the auger shaft and entire snow blower assembly. This upward force tends to cause the snow thrower to walk over the snow rather than remove it. As a result, the operator must exert a considerable downward force of the forward portion of the auger housing so as to insure that the snow is adequately removed. Of course, this requires considerable force on the operator's part and thus limits the ability of older or weaker persons to use such devices.

It is, therefore, a principal object of this invention to provide an improved snow thrower arrangement wherein the upward thrust exerted on the auger shaft is counterbalanced so that the operator need not exert a counterbalancing force.

It is a further object of this invention to provide an auger construction for a snow thrower wherein the auger itself and its drive arrangement incorporates a means for providing a downward thrust to counterbalance the upward thrust exerted by the snow on the auger.

SUMMARY OF THE INVENTION

This invention is adapted to be embodied in a snow blower that is comprised of an auger housing defining a forwardly facing opening that is adapted to engage and receive snow. An auger shaft extends transversely across the auger housing and has a pair of spaced apart auger portions for delivering snow entering the forwardly facing opening toward the center of the auger housing. Drive means are incorporated for driving the auger shaft. The rotation and operation of the auger portions and cooperation with the snow is effective to create an upward thrust on the auger shaft. In accordance with the invention, means are provided to cooperate with the snow for effecting a downward thrust on the auger shaft to counterbalance the upward thrust created by the auger operation.

DETAILED DESCRIPTION OF THE PREFERRED EMBODIMENT

Figure 1:
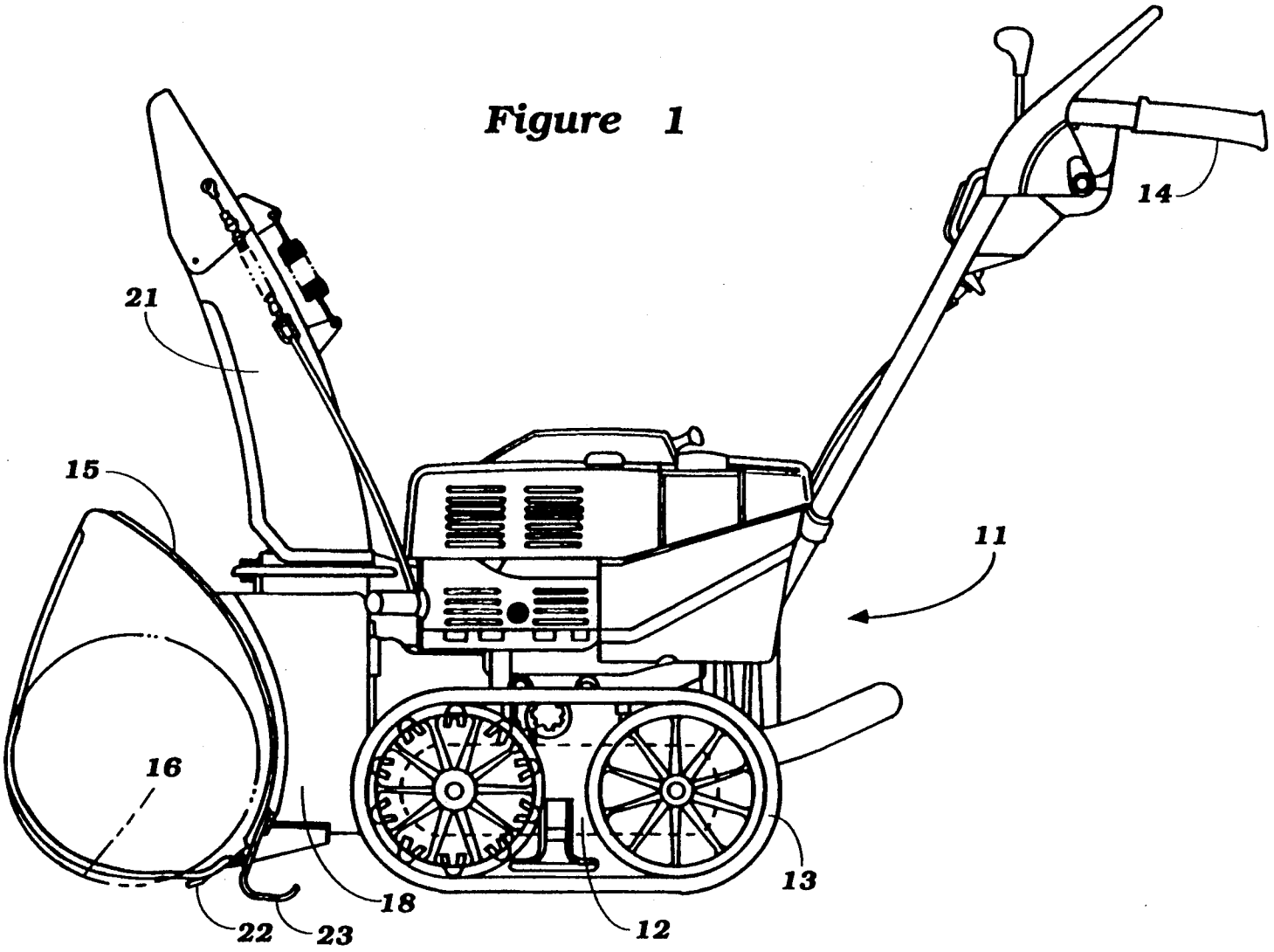
FIG. 1 is a side elevational view of a snow thrower constructed in accordance with an embodiment of the invention.
Figure 2:
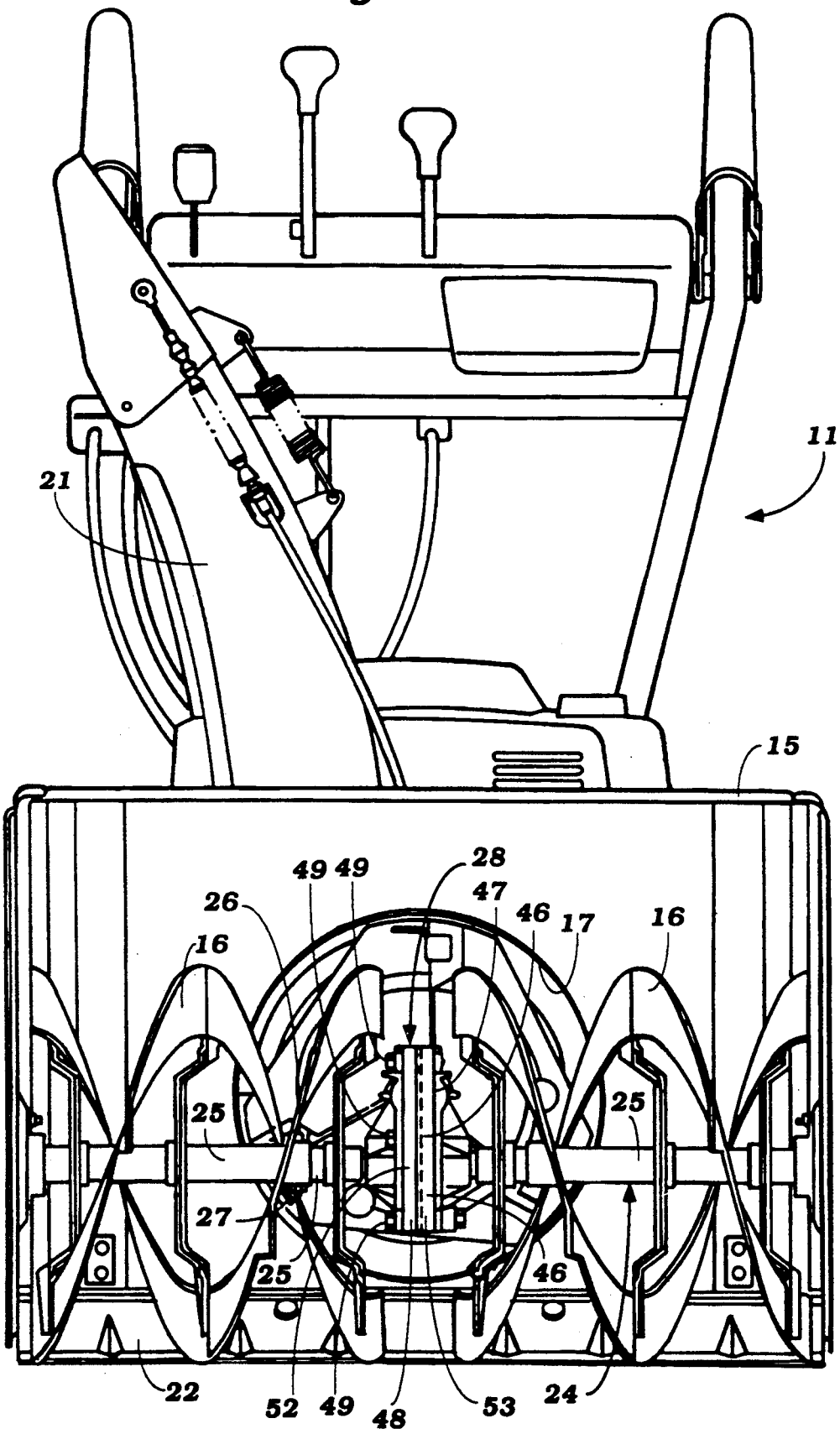
FIG. 2 is an enlarged front elevational view of the snow thrower.

Referring first primarily to FIGS. 1 and 2, a snow blower or thrower constructed in accordance with an embodiment of the invention is identified generally by the reference numeral 11. The snow blower 11 is comprised of a main body part 12 that supports a driving internal combustion engine (not shown) that drives a track 13 for moving the snow blower 11 along the ground. A handle and control assembly 14 extends upwardly and rearwardly from the main body portion 12 for operator control in a suitable manner.

At the forward portion of the main body portion 12 there is disposed a transversely extending auger housing 15 that has a forwardly facing opening as best seen in FIG. 2 and in which an auger assembly, indicated generally by the reference numeral 16, is positioned and driven in a manner to be described. The snow is collected from the auger assembly 16 and is transferred centrally of the auger housing 15 to a discharge opening 17 that communicates the auger housing 15 with an impeller housing 18. An impeller 19 is positioned within the impeller housing 18 and throws the collected snow for discharge through a discharge chute 21 that can be adjusted by the operator in a known manner so that the snow will be thrown away from the path being cleared.

There is provided a scraper blade 22 at the lower end of the auger housing opening for collecting snow that may pass by the auger and redirecting it to the blades of the auger 16. In addition, a skid plate 23 is supported behind the scraper blade 22 and engages the ground so as to assist in supporting the front portion of the snow thrower 11.

Figure 3:
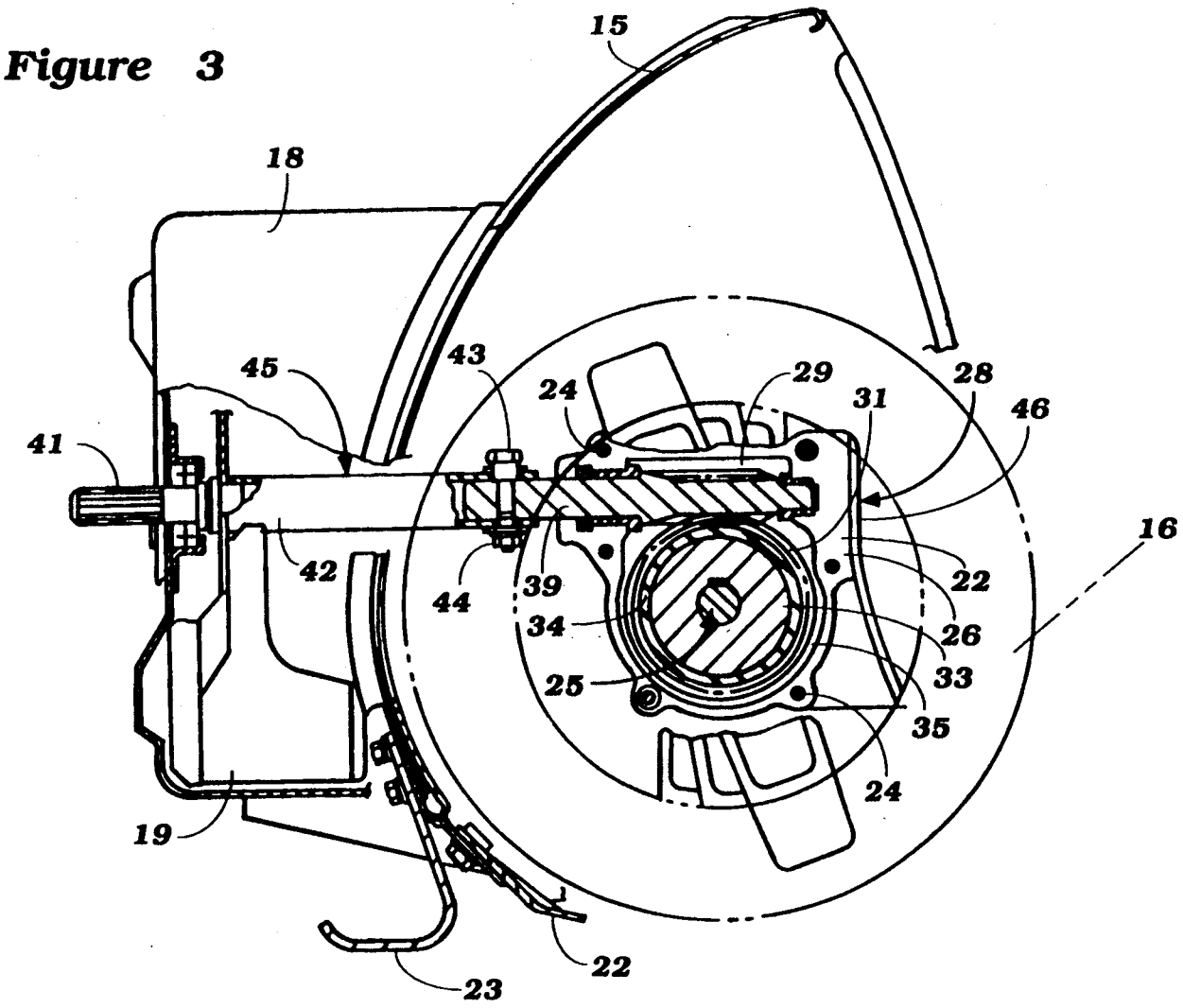
FIG. 3 is an enlarged side elevational view of the auger housing and drive therefor with a portion broken away and shown in section.

Referring now additionally to FIG. 3, the auger assembly 16 is supported upon an auger shaft, indicated generally by the reference numeral 24, that extends transversely the auger housing 15 and is journaled therein at its ends in a suitable manner. The auger blades 16 on each side of the center of the housing 15 are of opposite hands and are carried on tubular shafts 25 that have a connection to the auger shaft 24 by means of a shear bolt 26 and nut 27. As a result, if there is any substantial resistance to rotation, the shear bolt 26 will shear so as to reduce damage to the mechanism.

There is provided a drive gear housing assembly 28 at the center of the auger housing 15 which contains a worm gear 29 that meshes with a worm wheel 31. The worm wheel 31 has a resilient connection, indicated generally by the reference numeral 32, to a hub member 33 which hub member is splined or keyed to the auger shaft 24 for driving it.

Figure 7:
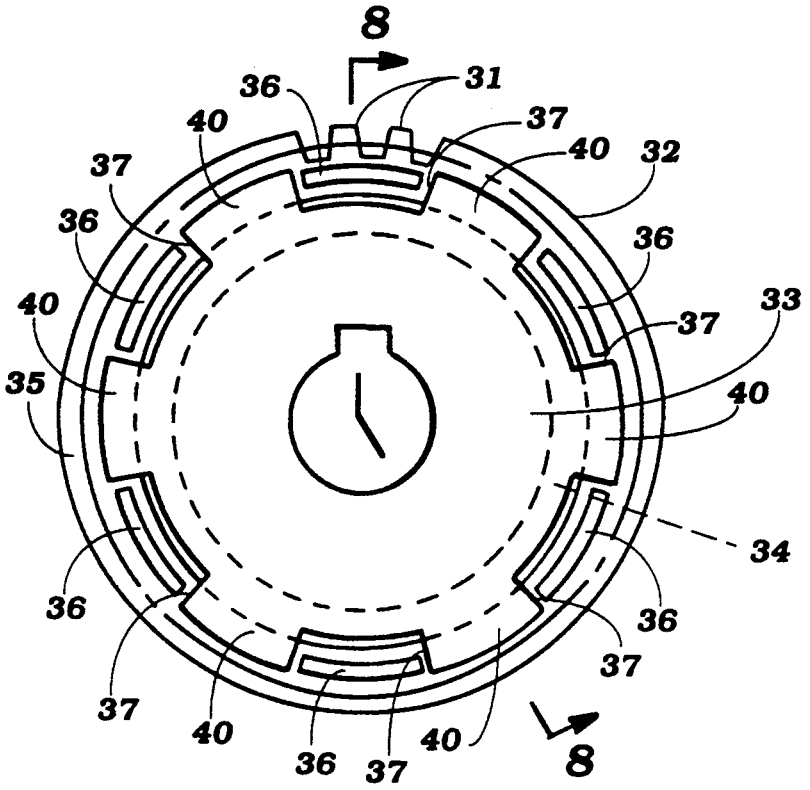
FIG. 7 is an enlarged side elevational view of the drive gear for the auger shaft.
Figure 8:
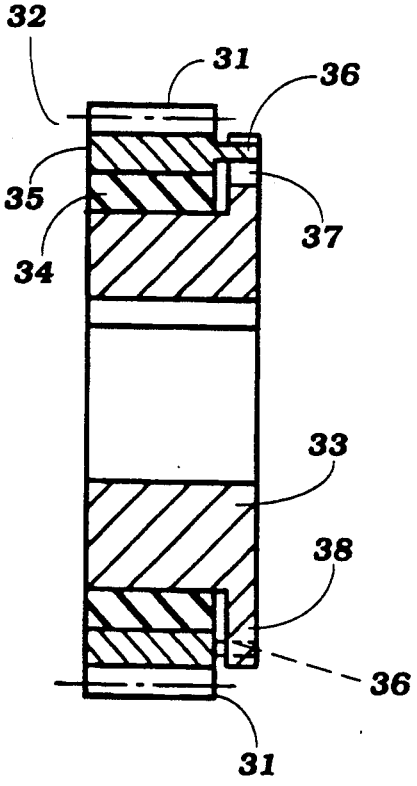
FIG. 8 is a cross-sectional view taken along the line 8—8 of FIG. 7.

As may be best seen in FIGS. 7 and 8, the resilient connection 32 is comprised of an elastic sleeve 34 that is bonded between a rim 35 of the worm wheel 31 and the rim of the hub 33 so as to provide a torsional damper therebetween. In addition, the rim 35 has a number of projections 36 that extend into enlarged slots 37 formed between projections 40 of a rim 38 of the hub 33 so as to limit the degree of torsional movement permitted. However, there is sufficient torsional flexibility to absorb variations in driving thrust and to reduce the likelihood of breakage.

The worm gear 29 is either fixed to or formed integrally with a drive shaft portion 39. The drive shaft portion 39 is connected to a drive shaft 41 which is driven from the engine shaft in a suitable manner by means of a tubular sleeve 42 and shear bolt 43 and nut 44. This forms a drive shaft assembly, indicated generally by the reference numeral 45. Like the shear bolt connecting the auger to the auger shaft, the shear bolt 43 will shear to provide protection in the event of excess loading.

Figure 4:
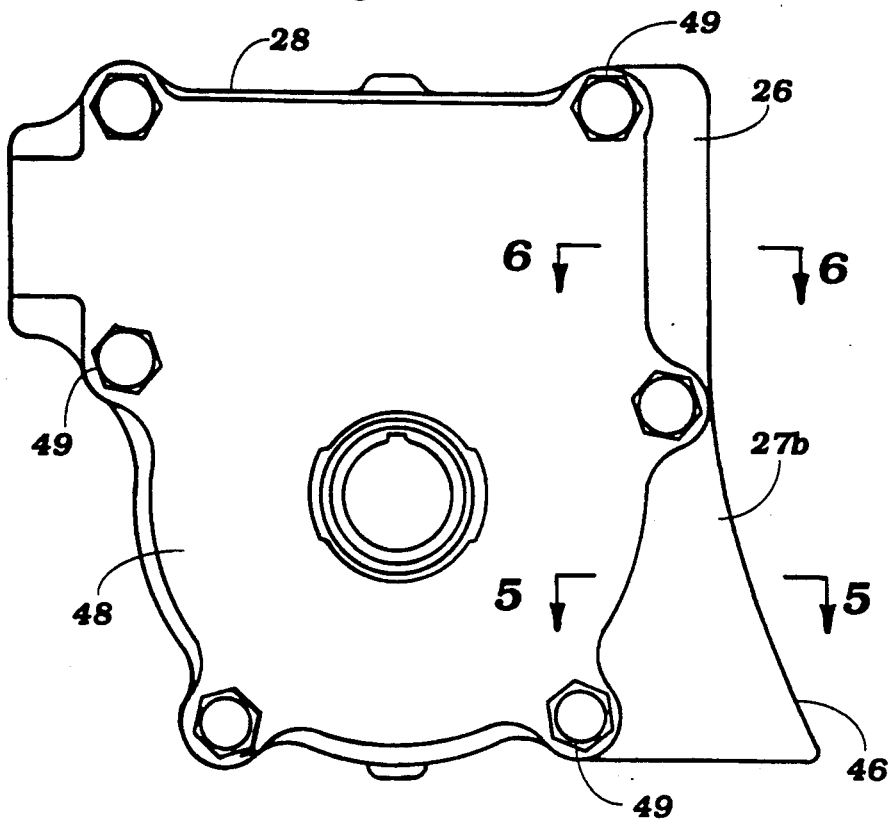
FIG. 4 is an enlarged side elevational view of the auger drive housing.

As is well known, the operation of the auger 16 with the snow tends to create an upward thrust on the snow thrower 11 which must be counterbalanced in normal constructions with either excess weight and/or driver force. However, in accordance with the invention, the gear housing 28 is provided with an inclined forward edge portion 46 as best shown in FIG. 4, which has a surface designed so as to co-act with the snow as the snow thrower 11 moves forwardly so as to provide a counterbalancing downward thrust. The surface 46 is, in the illustrated embodiment, depicted as being curved, but it may be merely inclined.

Figure 5:
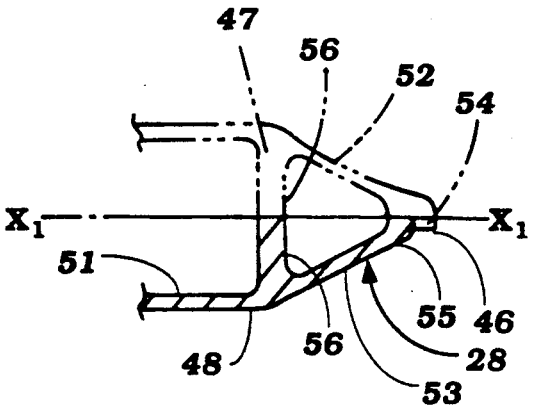
FIG. 5 is a cross-sectional view taken along the line 5—5 of FIG. 4.
Figure 6:
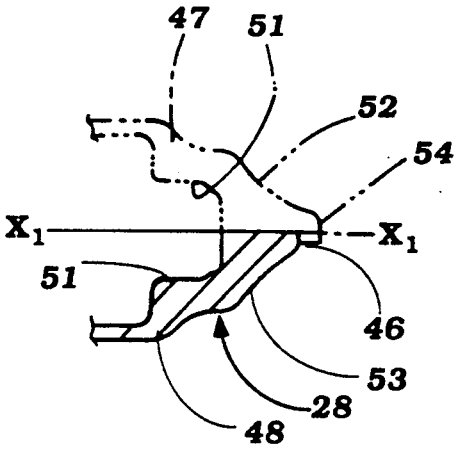
FIG. 6 is a cross-sectional view taken along the line 6—6 of FIG. 4.

As may be seen in FIGS. 5 and 6, the housing assembly 28 is made up of a first housing half 47 and a second housing half 48 that are secured to each other by means of a plurality of transversely bolt and nut assemblies 49. The housing halves 47 and 48 define an internal cavity 51 in which the worm gear 29 and worm wheel 31 are received. In addition, the housing halves 47 and 48 have forwardly extending portions 52 and 53 respectively which define the forward surface 46. It should be noted that the housing half 47 has a flange portion 54 that overlies the forward end 55 of the housing half 48 so that the joint between the two halves which lies along the line $X_1$—$X_1$ will be protected from damage. In addition, the larger lower portion of the front of the housing 28 may be provided with a cavity 56 for weight lightening.

Although an embodiment of the invention has been illustrated and described, variations and modifications may be made without departing from the spirit and scope of the invention, as defined by the appended claims.

I claim:

1. A snow thrower comprised of an auger housing defining a forwardly facing opening adapted to engage and receive snow, an auger shaft extending transversely across said auger housing and having a pair of spaced apart auger portions for delivering snow entering said forwardly facing opening toward the center of said auger housing, drive means for driving said auger shaft, the rotation and operation of said auger portions in cooperation with the snow and with said auger housing being effective to create a net upward thrust upon said auger shaft and said auger housing, and means mounted directly to said snow thrower auger shaft and other than said auger housing and said auger portions for cooperating with the snow for effective a downward thrust on said auger shaft and said auger housing in opposition to said spaced thrust.

2. A snow thrower as set forth in claim 1 wherein the means for cooperating with snow for effecting the downward thrust on the auger shaft comprises a static device.

3. A snow thrower as set forth in claim 2 wherein the static device has a forwardly facing generally downwardly inclined shape for creating a reactive force in a downward direction on the auger shaft.

4. A snow thrower as set forth in claim 3 wherein the static device is positioned centrally of the auger housing.

5. A snow thrower as set forth in claim 1 wherein the driving means for driving the auger shaft and includes a transmission for driving the center of the auger shaft.

6. A snow thrower as set forth in claim 5 wherein the means for cooperating with snow for effecting the downward thrust on the auger shaft comprises a static device.

7. A snow thrower as set forth in claim 6 wherein the static device has a forwardly facing generally downwardly inclined shape for creating a reactive force in a downward direction on the auger shaft.

8. A snow thrower as set forth in claim 7 wherein the static device comprises an outer housing of the transmission for driving the auger shaft.

9. A snow thrower as set forth in claim 8 wherein the transmission housing is formed by a pair of interconnected sections having a parting line extending generally longitudinally of the snow thrower, one of said sections having a peripheral flange overlapping the other of the sections to protect the mating faces from the intrusion of snow.

10. A snow thrower as set forth in claim 9 wherein the transmission for driving the auger shaft further includes a pair of intermeshing gears comprising a driving gear driven by an internal combustion engine and a driven gear rotatably coupled to the auger shaft.

11. A snow thrower as set forth in claim 10 wherein the rotatable coupling to the auger shaft includes damping means.

12. A snow thrower as set forth in claim 1 wherein the means for driving an auger shaft further includes a transmission comprised of a pair of intermeshing gears comprising a driving gear driven by an internal combustion engine and a driven gear rotatably coupled to the auger shaft.

13. A snow thrower as set forth in claim 12 wherein the rotatable coupling to the auger shaft includes damping means.

14. A snow thrower as set forth in claim 13 wherein the damping means comprises means defining a lost motion connection between the driven gear and the auger shaft and elastomeric means interposed in said lost motion connection for providing the damping.

* * * * *